United States Patent [19]

Themig

[11] Patent Number: 4,942,925

[45] Date of Patent: Jul. 24, 1990

[54] LINER ISOLATION AND WELL COMPLETION SYSTEM

[75] Inventor: Daniel J. Themig, Oklahoma City, Okla.

[73] Assignee: Dresser Industries, Inc., Dallas, Tex.

[21] Appl. No.: 396,563

[22] Filed: Aug. 21, 1989

[51] Int. Cl.[5] ..... E21B 23/00; E21B 23/06; E21B 33/129

[52] U.S. Cl. ..... 166/382; 166/123; 166/134; 166/208; 166/237; 285/18

[58] Field of Search ..... 166/382, 387, 237, 380, 166/134, 123, 208, 369; 285/18, 144, 146, 147

[56] References Cited

U.S. PATENT DOCUMENTS

| | | | |
|---|---|---|---|
| 3,695,358 | 10/1972 | Blount et al. | 166/208 X |
| 3,842,912 | 10/1974 | Lindsey, Jr. | 166/307 |
| 3,993,128 | 11/1976 | Braddick | 166/216 |
| 3,999,605 | 12/1976 | Braddick | 166/212 |
| 4,083,408 | 4/1978 | Milam | 166/208 X |
| 4,106,565 | 8/1978 | Braddick | 166/118 |
| 4,171,018 | 10/1979 | Walker | 166/208 X |
| 4,281,711 | 8/1981 | Braddick et al. | 166/118 |
| 4,287,949 | 9/1981 | Lindsey, Jr. | 166/212 |
| 4,391,325 | 7/1983 | Baker et al. | 166/208 |
| 4,399,873 | 8/1983 | Lindsey, Jr. | 166/380 |
| 4,482,014 | 11/1984 | Allwin | 166/136 |
| 4,497,371 | 2/1985 | Lindsey, Jr. | 166/377 |
| 4,498,534 | 2/1985 | Lindsey, Jr. | 166/208 |
| 4,601,343 | 7/1986 | Lindsey, Jr. et al. | 166/382 |
| 4,603,743 | 8/1986 | Lindsey, Jr. | 166/382 |
| 4,646,842 | 3/1987 | Arnold et al. | 166/382 |
| 4,671,358 | 6/1987 | Lindsey, Jr. et al. | 166/291 |
| 4,681,159 | 7/1987 | Allwin et al. | 166/124 |
| 4,688,642 | 8/1987 | Baker | 166/382 |
| 4,690,220 | 9/1987 | Braddick | 166/382 |
| 4,712,614 | 12/1987 | Allwin et al. | 166/208 |
| 4,712,615 | 12/1987 | Dockins, Jr. et al. | 166/208 |
| 4,823,872 | 4/1989 | Hopmann | 166/217 |
| 4,825,954 | 5/1989 | Baugh | 166/382 |
| 4,828,037 | 5/1989 | Lindsey et al. | 166/382 |

*Primary Examiner*—Stephen J. Novosad

[57] ABSTRACT

In a wellbore having a liner hung from a higher string of pipe, a permanent packer and a seal unit are utilized to isolate the annulus between the liner and the wellbore surface. The downhole completion assembly, which comprises an on-off tool, a latch and seal assembly and a tailpipe, can be lowered into the packer and seal unit by the production tubing, with the latch mechanism of the latch and seal assembly snapping into a threaded portion of the packer. The on-off tool can be disconnected and the production tubing withdrawn from the well. Alternatively, the latch mechanism can be disengaged and the entire downhole completion assembly can be withdrawn from the well in a single trip.

16 Claims, 3 Drawing Sheets

LINER ISOLATION AND WELL COMPLETION SYSTEM

TECHNICAL FIELD OF THE INVENTION

This invention relates to method and apparatus for use in oil field completion operations involving liner hanger systems. In one particular aspect, the invention relates to method and apparatus for isolating a well liner and for completing the well for high pressure service.

BACKGROUND OF THE INVENTION

The drilling of an oil well generally involves drilling the borehole in successive stages with each stage having a borehole diameter which is less than the borehole diameter of the preceding stage As each of the upper stages of the borehole is drilled, a string of tubular casing pipe is inserted into the borehole, extending from the earth's surface to a location adjacent the current bottom of the borehole. This string of casing pipe is generally cemented in place The column of cement, in the annulus formed by outer surface of the casing pipe and the borehole wall, supports the casing pipe and at least substantially prevents fluid migration along the annulus. Then a smaller diameter drill is lowered through the casing and the next stage of the borehole is drilled. Eventually extending the new casing all the way from the earth surface becomes undesirable, and then the newest borehole stage is cased by lowering a string of liner pipe into the borehole and hanging this liner from the lower end of the lowermost string of pipe already in the borehole, followed by cementing the liner in place. The drilling, lining and cementing operations can continue until the desired depth is achieved.

To position and cement a liner in a string of casing, the liner is made up with the usual bottom hole equipment which includes a casing shoe, float collar and plug catchers and is connected up to the desired length. At the top of the liner is a liner hanger which is an assembly having slip elements which are normally retracted while going into the borehole and which are released downhole when setting of the liner hanger is desired. The liner hanger is lowered into the borehole by a setting tool which attaches to the liner hanger and a string of pipe attached to the setting tool. At the desired location where the casing shoe is preferably located above the bottom of the open borehole, the liner hanger is set in the next above casing by actuating the setting tool to set the slips on the liner hanger. Upon setting the liner hanger, the weight of the liner is suspended by the liner hanger on the next above casing. The setting tool is released and the liner hanger is then cemented by pumping cement through the string of pipe and through the liner and into the annulus between the liner and borehole After the cement is set up, any remaining cement in the liner can be removed by drilling through the liner and destructible cement equipment at the lower end of the liner. When the open borehole reaches the projected well depth and traverses the formations to be completed, the liner includes a liner hanger and oftentimes a polished bore receptacle (PBR). The polished bore receptacle attaches either above or below the liner hanger and provides a bore to receive a sealing member on a production tubing string.

The production string of tubing, which has a sealing element adapted to be slidingly and sealingly received in the polished bore receptacle, extends from the earth's surface. When the well is completed, fluids from the earth formation being produced flow through the tubing string to the production equipment at the earth's surface. The sealing element on the string of tubing is subjected to downhole hydraulic pressure forces, and the tubing string is subjected to expansion and contraction forces due to changes in the temperature of the fluid in the tubing string. The purpose of a sliding seal on a string of tubing in a polished bore receptacle generally is to permit movement of the seal and the string of tubing relative to the polished bore receptacle.

When the producing formation is at high pressure conditions, it is possible for high pressure fluid to seep through the annular sleeve of concrete which exists between the outside of the liner and the surrounding earth formation. Such seepage can rise and enter the annular gap between the overlap of the top of the liner in the producing formation and the bottom of the next higher cemented string of pipe. In the absence of any sealing mechanism for the annular gap, the high pressure fluid can fill the annulus between the production tubing and the casing. The production tubing can have a higher pressure rating for a lower cost than the casing pipe because of the relatively small diameter of the production tubing compared to the diameter of the casing pipe. Accordingly, it is generally desirable to reduce costs by using casing pipe with a substantially lower pressure rating than the production tubing Thus, leakage of the high pressure fluid into the annulus between the production tubing and the casing can cause damage to the lower pressure rated casing.

One solution for the leakage problem is to install a packer to seal the annular gap between the liner and the casing, in combination with a second polished bore receptacle (PBR) positioned within the packer to seal off the annulus between the production tubing and the liner. Each PBR can be as much as thirty feet long and is very expensive due to the manufacturing requirements for its polished interior surface. In many downhole completions using a permanent packer, the tailpipe is run as part of the packer assembly and becomes a permanent part of the well, unless the permanent packer is also removed. The presence of the tailpipe in the wellbore restricts access to the liner because of the small size of the tailpipe. Some downhole completions utilize a landed seal assembly, but this requires two trips to retrieve.

Accordingly, it is an object of the present invention to provide new and improved method and apparatus for isolating a liner and providing a seal between production tubing and the liner. Another object of the invention is to permit the downhole production completion assembly to be disconnected from the liner isolation seal and be removed from the borehole in a single trip. A further object of the invention is to permit the removal of the production tubing from the borehole while maintaining a high pressure seal between the producing formation and the borehole casing above the producing formation. Other objects, aspects and advantages of the invention will be apparent from the following description, the drawings and the appended claims to the invention.

SUMMARY OF THE INVENTION

The annulus around a wellbore liner can be isolated by positioning a tubular member within the liner with the tubular member extending upwardly from a first position within the axial bore of the liner to a second position within the axial bore of the next higher string of pipe above the upper end of the liner. The tubular member can be provided with a first annular seal between the tubular member and the liner, and a second annular seal between the tubular member and the next higher string of pipe. The downhole completion can be achieved by lowering a string of production pipe, having on the lower end thereof an on-off tool, a latch and seal assembly connected to the lower end of the on-off tool, and a tailpipe extending downwardly from the latch and seal assembly, until the latch and seal assembly is positioned within the tubular member and said tailpipe extends at least partially below the bore of the packer. The latch and seal assembly can then be activated to releasably secure the latch and seal assembly to the tubular member and to provide a fluid seal for the annulus between the interior surface of tubular member and the exterior surface of said latch and seal assembly.

Production fluid from the producing formation can be withdrawn via the tailpipe, the latch and seal assembly, the on-off tool, and the string of production pipe. When it is desirable to pull the production tubing, a plug can be inserted into the tailpipe to seal off the producing formation, the on-off tool can be activated for separation of the production tubing from the downhole completion assembly, and the production tubing can then be withdrawn from the borehole while leaving the producing formation at high pressure condition. If access to the wellbore below the tailpipe is desired, the downhole completion assembly can be withdrawn by activating the latch and seal assembly to release from the tubular member, and retrieving the downhole completion equipment in a single trip.

DETAILED DESCRIPTION

Figure 1:
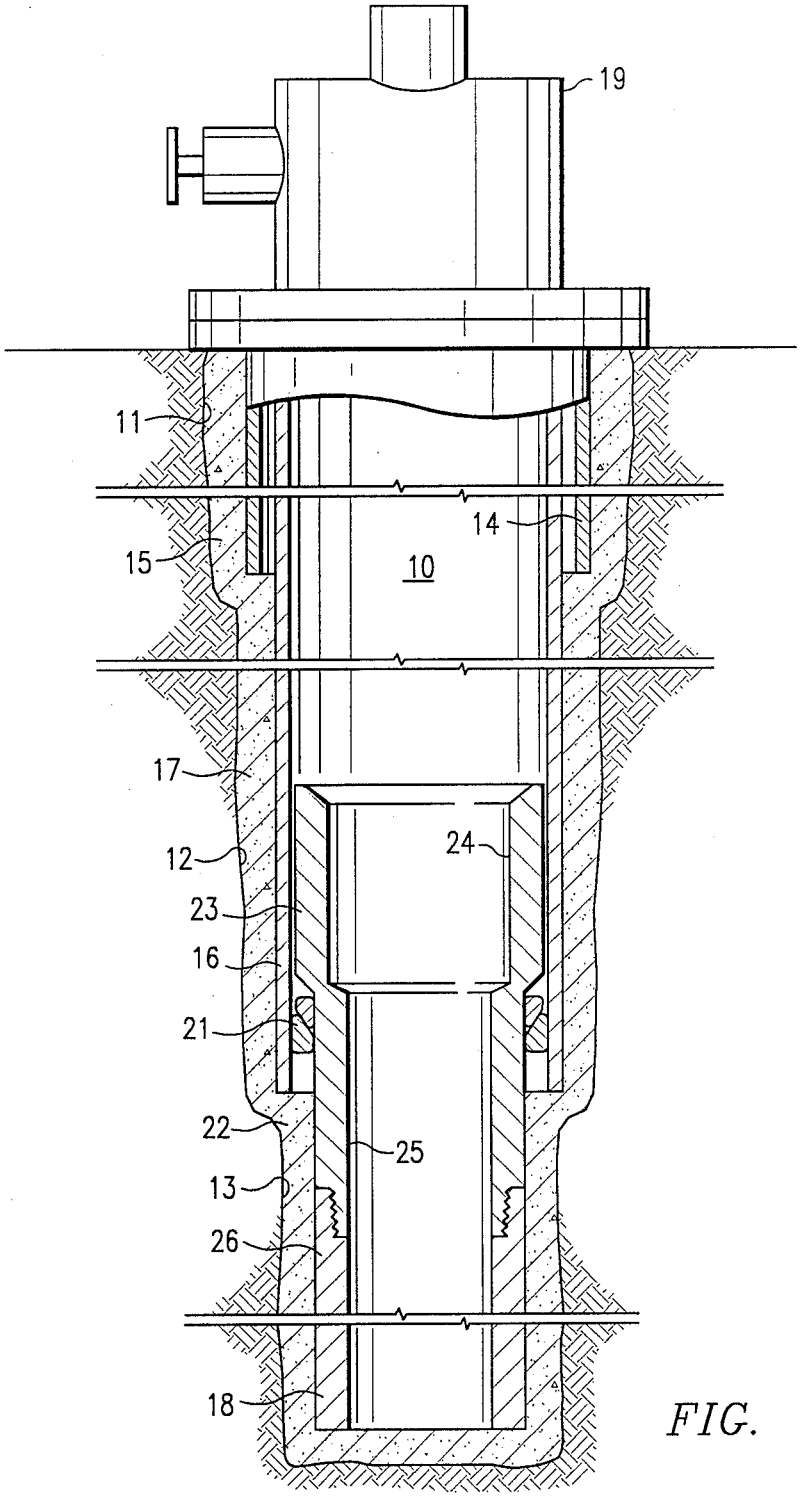
FIG. 1 is a vertical sectional view of a well bore which has been lined by successively smaller diameter pipe strings cemented in place, with at least the lowermost pipe string being a liner which has been hung from a lower portion of the next higher pipe string.

Referring now to FIG. 1, a borehole 10 extends vertically downwardly into the earth traversing various formations, including at least one producing formation. The borehole 10 has been drilled in a plurality of stages 11, 12 and 13 with each stage having a smaller borehole diameter than the immediately preceding stage. A string of casing pipe 14 was inserted into upper borehole stage 11 and secured in place by the formation of cement sleeve 15 filling the annular space between the exterior surface of casing 14 and the adjacent exposed earthen surface of the borehole. Similarly, a string of casing pipe 16 was inserted into intermediate borehole stage 12 and secured in place by the formation of cement sleeve 17, with the lower end of string 16 being substantially above the ultimate bottom of borehole 10. Thus, pipe string 14 serves as a liner or casing for the vertical portion of wellbore 10 represented by first stage 11, while pipe string 16 serves as a liner or casing for the vertical portion of wellbore 10 represented by intermediate stage 12.

A string of liner pipe 18 has been positioned in the lower borehole section 13. Unlike casings 14 and 16, which extend to the earth surface and are directly connected to the wellhead 19, liner 18 extends upwardly only into the lowermost portion of the next higher pipe string 16. Each of pipe strings 14, 16 and 18 has an axial bore therethrough at least generally parallel to the axis of borehole 10. The external diameter of pipe string 18 is less than the internal diameter of the bore of pipe string 16. Similarly, the external diameter of pipe string 16 is less than the internal diameter of the bore of pipe string 14. Liner string 18 is initially suspended from the lowermost portion of pipe string 16 by means of a conventional liner hanger assembly 21 positioned within the bore of string 16. Assembly 21 achieves a mechanical engagement with the inner surface of the bore of pipe string 16 and the outer surface of liner string 18. The liner string 18 can then be cemented in place by the formation of cement sleeve 22, in the same manner as the casing strings 14 and 16 were cemented in place. Thus, pipe string 18 serves as a liner for the vertical portion of wellbore 10 which extends downwardly from the lower end of pipe string 16.

In addition to the liner hanger assembly 21, the string 18 of liner pipe is also provided with a relatively short polished bore receptacle (PBR) 23. In contrast to the approximately 30 foot length of many PBR's intended for use as a telescoping joint, the PBR 23 can be on the order of only six feet in length. PBR 23 has an upper bore section 24 which is highly polished and a lower bore section 25 which has a smaller internal diameter than upper bore section 24. A normal liner pipe 26 is attached to the lower end of PBR 23. The liner string 18 can be made up with the PBR 23 above the liner hanger assembly 21, as illustrated, or with the liner hanger assembly 21 above the PBR 23. While the cement sleeve 22 is shown as extending upwardly only to the bottom of casing string 16 for simplicity of illustration, it is generally customary for the cement 22 to continue upwardly to the top of the liner string 18, including the PBR 23 and liner hanger assembly 21. As the cement sleeve 22 is not completely impermeable to well fluids, it is possible for fluids under sufficiently high pressure at the bottom of the borehole 10 to seep upwardly through cement sleeve 22 and into the interior of casing 16.

Figure 2:
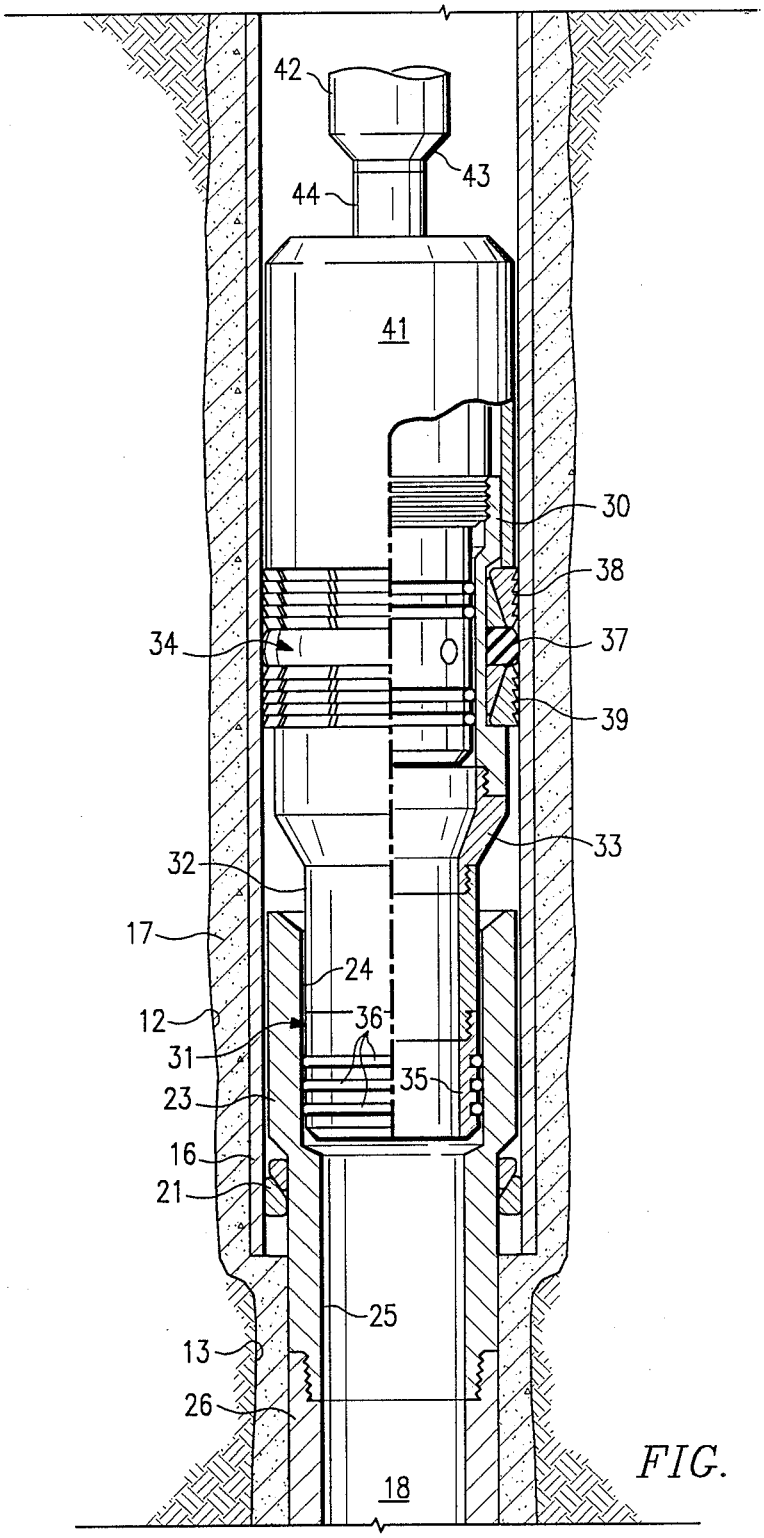
FIG. 2 corresponds to the lower portion of FIG. 1 with an isolation packer and seal unit, shown partially in cross section, having been lowered into place by a drill pipe string and hydraulic setting tool.

Referring now to FIG. 2, a seal unit 31 is connected by extension sleeve 32 and crossover 33 to the bottom of tubular isolation packer 34. The tubular member 35 of seal unit 31 has an external diameter which is slightly smaller than the internal diameter of the upper bore section 24 of PBR 23, and is provided with a plurality of circumferentially extending seals 36 to contact the interior surface of bore section 24 and thereby seal the annular space between the exterior of seal unit 31 and the interior surface of bore section 24. Isolation packer 34 is provided with at least one expandable elastomeric ring 37 extending circumferentially about the tubular member 30 of packer 34 and which has been subjected to compression in a direction parallel to the longitudinal axis of borehole 10 by suitable actuating means to cause the annular ring 37 to expand radially outwardly into sealing engagement with the interior surface of the bore of the laterally adjacent portion of pipe string 16. Packer 34 is also provided with slip mechanisms 38 and 39 extending circumferentially about tubular member 30 and which have been moved radially outwardly into frictional engagement with the interior surface of the bore of pipe string 16 to immobilize the packer 34 in pipe string 16.

A conventional hydraulic setting tool 41 is in threaded engagement with the upper end of packer 34 and is secured to the lower end of drill pipe or tubing 42 by a crossover section 43 and extension 44. Packer 34 and seal unit 31 can be lowered into borehole 10 by drill pipe or tubing 42 and setting tool 41 until seal unit 31 has entered and sealingly engaged the polished bore 24 of PBR 23. Setting tool 41 can then be utilized to cause elastomeric ring 37 to sealingly engage the interior surface of the bore of pipe string 16 and to cause slips 38 and 39 to mechanically grip the interior pipe surface of the bore of string 16. Such engagement by slips 38 and 39 prevents movement of packer 34 upwardly or downwardly in pipe string 16. After the packer 34 has been activated, the drill pipe 42 can be rotated to unscrew setting tool 41 from packer 34, and the drill pipe 42 and setting tool 41 can be withdrawn from the borehole 10. The packer 34, crossover 33, tubular extension 32 and seal unit 31 isolate the annulus between the exterior surface of PBR 23 and the interior surface of the bore of pipe string 16 from the interior of pipe string 18 and from the interior of pipe string 16 above packer 34, while permitting fluid communication between the interior of pipe string 18 and the interior of pipe string 16 above packer 34 via their axial bores.

Figure 3:
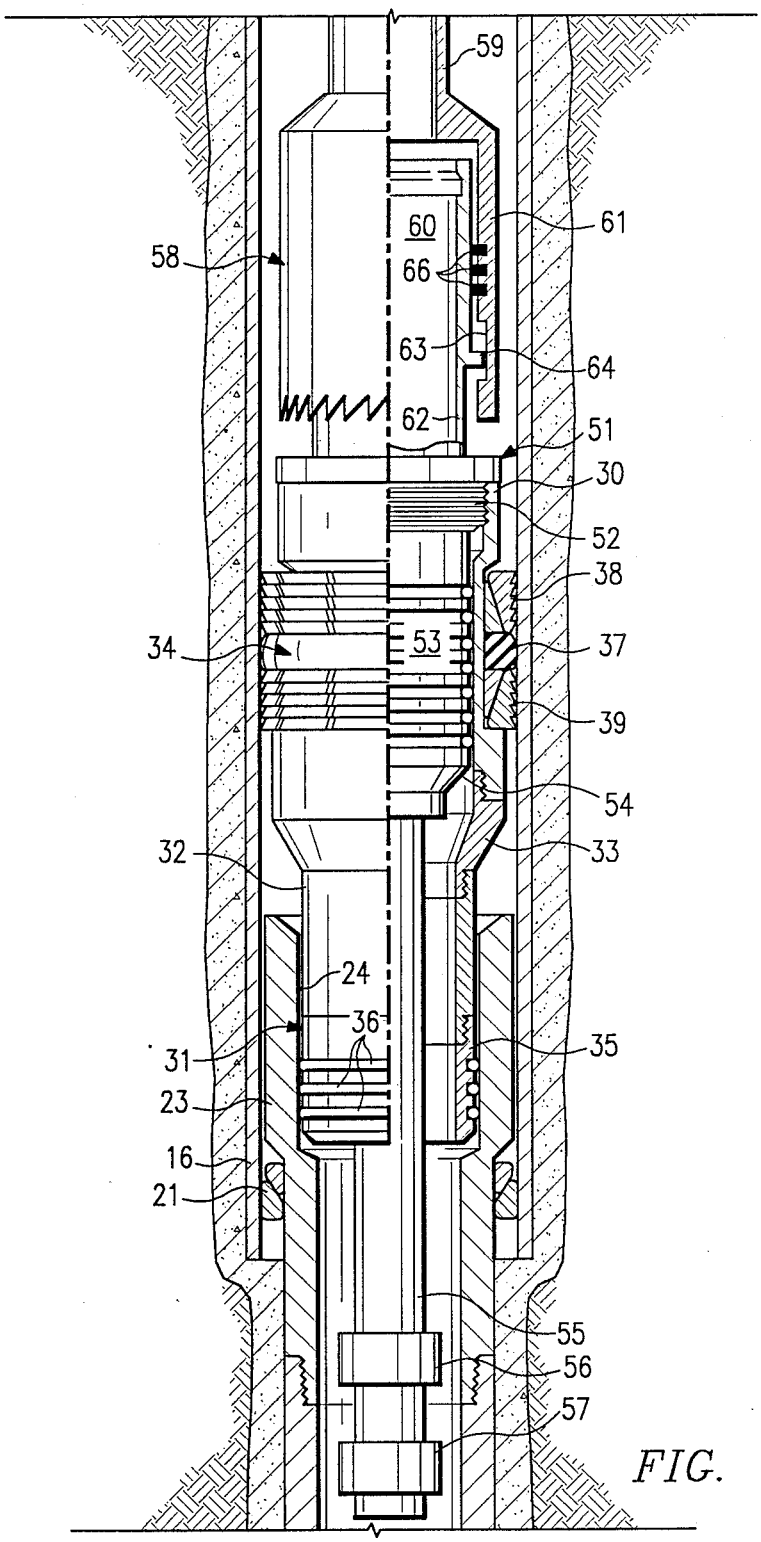
FIG. 3 corresponds to FIG. 2 after the packer has been set in place, the hydraulic setting tool has been removed and production completion assembly has been lowered into place by the production tubing.

Referring to FIG. 3, the setting tool 41 has been removed from the well bore 10 and the downhole production completion assembly has been positioned in place. A latch seal assembly 51 has a latch seal nipple 52, a seal unit 53, and a crossover unit 54. The latching elements of the latch seal nipple 52 snap into engagement with the threads on the female collar at the top of the tubular member 30 of packer 34 when the latch seal assembly is lowered into the packer 34. The latch seal assembly 51 can be rotated to unscrew it from the packer 34, permitting the latch seal assembly to be removed from the well bore if that becomes necessary. A tubular tailpipe 55, having profile collars 56 and 57 therein, is secured to the lower portion of crossover unit 54.

An on-off tool 58 is connected between the lower end of production tubing 59 and the upper end of latch seal assembly 51. The on-off tool 58 has an outer tubular skirt 61 secured to the lower end of production tubing 59 by suitable means, e.g. threaded engagement. Tool 58 has an inner tubular skirt 62 secured to the upper end of latch seal assembly 51 by suitable means. The on-off tool 58 has a bore 60 therethrough which is approximately coaxial with the bore of production tubing string 59, the bore latch seal assembly 51, and the bore of tailpipe 55 to provide fluid communication between the bore of liner 18 and the bore of production tubing string 59. Skirt 61 has an upside-down J-shaped groove 63 cut in its interior surface, while skirt 62 is provided with a pin 64 which projects outwardly therefrom into groove 63. A plurality of annular seals 66 are positioned on the exterior of tubular element 62 in sealing engagement with the interior surface of outer tubular element 61 in a region axially spaced from the slot 63. Thus, outer tubular element 61 is movable axially with respect to inner tubular element 62, from a first position with sleeves 61 and 62 being releasably secured to each other to a second position wherein sleeves 61 and 62 are separated from each other. This is accomplished by pin 64 sliding in the long leg of the slot 63, and seals 66 providing a fluid seal between the exterior of inner element 62 and the interior of outer element 61 during engagement of sleeves 61 and 62. Alternately, the production tubing 59 and outer tubular element 61 can be lowered to place the pin 64 at the curved arc of the slot 63 and then the tubing 59 and element 61 can be rotated a quarter-turn, thereby permitting tubing 59 to be raised, separating outer sleeve 61 from the inner sleeve 62.

Slot 63 can be a groove having a depth less than the thickness of sleeve 61, or it can extend through the sleeve 61. While the slot 63 and pin 64 have been illustrated on sleeves 61 and 62, respectively, they can be reversed if desired.

The downhole completion assembly, comprising on-off tool 58, latch seal assembly 51 and tailpipe 55, can be attached to the lower end of production tubing string 59 and lowered into the wellbore until the latch seal assembly 51 is positioned within tubular element 30 and tailpipe 55 extends at least partially below the bore of the packer. The latch seal assembly can then be activated to engage the threaded portion of packer 34 to releasably secure the latch seal assembly to packer 34. Production fluid from the producing formation can be passed from the bore of liner 18 through tailpipe 55, latch seal assembly 51, on-off tool 58 and production tubing 59 to the above ground production facilities.

If it is desirable to removing the tubing string 59 while the production is still viable, a plug can be lowered through the production tubing 59 and inserted into one of the profile nipples 56, 57 in tailpipe 55 to seal off the producing formation. Then the on-off tool 58 can be rotated to disconnect the production tubing 59 from latch seal assembly 51, and the production tubing 59 can be withdrawn from the well. If for any reason it is desired to retrieve the latch seal assembly 51 and tailpipe 55, the tubing string 59 can be rotated to unscrew the latch seal assembly from the packer 34, and then the tubing 59, on-off tool 59, latch seal assembly 51 and tailpipe 55 can be withdrawn in a single trip of the tubing.

Each of liner hanger 21, PBR 23, packer 34, seal unit 31, latch seal assembly 51, tailpipe 55 and on-off tool 58 can be any suitable device which is commercially available for the intended purpose. While the devices selected can vary according to the size and other environmental limitations, one suitable combination for isolating and completing a 4-½" liner hung from a 7"casing, with a 2-⅞" production tubing, is as follows:

| Device | Commercially Available Equipment |
|---|---|
| On-off tool 58 | 7" × 2⅞" Guiberson XL on-off tool with 3 bonded seals (10,000 psi pressure rating), model #89207, with a 2.313" type, X profile nipple |
| Latch seal 51 | 4" × 2⅞" latch seal assembly containing a Guiberson model #83089 latch seal nipple, a one foot seal unit model #83082, and a crossover to 2⅞" tubing thread |
| Packer 34 | 7" × 4.00" Guiberson bore magnum "GT" drillable packer, model #82063 |
| Tailpipe 55 | One 10' × 2⅞" N-80 tubing pup, one 2.313" type "XN" profile nipple with 2.205" no-go, and one wireline re-entry collar. |

The on-off tool can be released by slacking off on the tension on tubing 59, rotating tubing 59 ¼ turn to the left and then raising tubing 59. The on-off tool 58 can be automatically reset by slacking off on the tubing 59 with the two sleeves of the on-off tool contacting each other, and then pulling tension to insure that the tubing is latched. The latch seal 51 can be released by pulling 500 pounds tension and then rotating tubing 59 eight turns to the right. The latch seal automatically reseats upon being lowered into contact with the threads of packer 34 and slacking off of the tension of tubing 59. This system can be used for stimulation, production or workover operations. Reasonable variations and modifications are possible within the scope of the foregoing description and the appended claims to the invention.

I claim:

1. In a wellbore which transverses various earth formations, a first string of pipe for lining a first vertical portion of said wellbore, said first string of pipe having a lower end which is above the bottom of said wellbore, a second string of pipe for lining a second vertical portion of said wellbore, said second vertical portion extending downwardly from said lower end of said first string of pipe, each of said first and second strings of pipe having an axial bore therethrough, the outer diameter of said second string of pipe being smaller than the inner diameter of said first string of pipe, a polished bore receptacle and liner hanger assembly connected to the upper end of said second string of pipe and having a fluid passageway therethrough, said assembly having a liner hanger positioned within the bore of said first string of pipe and in mechanical engagement with the interior surface of the bore of a lower portion of said first string of pipe to suspend said second string of pipe from said lower portion of said first string of pipe, said assembly having a polished bore receptacle with a polished interior bore forming at least a portion of said passageway, the improvement comprising a tubular packer positioned within the bore of said first string of pipe at a location above said assembly, said packer having at least one gripping means in frictional engagement with the interior surface of the bore of said first string of pipe to immobilize said packer in said first string of pipe, said packer having a tubular element with an internal bore extending axially therethrough, at least one annular packer seal extending circumferentially about said tubular element and in contact with the interior surface of the bore of said first string of pipe to provide a fluid seal between the exterior surface of said tubular element and the interior surface of the bore of said first string of pipe, a seal unit having a tubular member and at least one annular seal extending circumferentially about said tubular member, said seal unit being positioned in said polished interior bore with said at least one annular seal of said seal unit being in contact with said polished interior bore to form a fluid seal between said tubular member and said polished bore receptacle, means for connecting the upper portion of said tubular member of said seal unit to the lower portion of said tubular element of said packer, a string of tubing positioned within the bore of said first string of pipe, an on-off tool having a first sleeve and a second sleeve, means for connecting said first sleeve to the lower end of said string of tubing, means for releasably securing said first sleeve to said second sleeve, a latch and seal assembly having latching means in engagement with the upper portion of said tubular element of said packer, and having a tubular section extending downwardly from said latching means within said tubular element of said packer, at least one annular seal extending circumferentially about said tubular section and in contact with the interior surface of the internal bore of said tubular element of said packer to provide a fluid seal between the exterior surface of said latch and seal assembly and the interior surface of said internal bore of said packer, means for connecting said latch and seal assembly to said second sleeve of said on-off tool, a tailpipe, and means for connecting said tailpipe to the lower portion of said tubular section, whereby the only fluid communication between the interior of said second string of pipe and the interior of said string of tubing is through said tailpipe, said latch and seal assembly and said on-off tool.

2. Apparatus in accordance with claim 1 wherein said means for releasably securing said first sleeve to said second sleeve comprises:

one of said first and second sleeves having a J shaped slot therein and the other of said first and second sleeves having a projection thereon which is adapted to project into and slide within said slot between a first position wherein said first and second sleeves are thereby secured together and a second position wherein said first and second sleeves are separated from each other.

3. Apparatus in accordance with claim 2 further comprising at least one profile nipple in said tailpipe, whereby a plug can be lowered through said string of tubing into said tailpipe to engage said profile nipple and thereby seal the interior of said second string of pipe from the interior of said tailpipe above the thus plugged profile nipple.

4. Apparatus in accordance with claim 3 wherein, in said polished bore receptacle and liner hanger assembly, said polished bore receptacle extends above said liner hanger.

5. Apparatus for isolating the annulus around a wellbore liner and for achieving down-hole completion in a wellbore which transverses various earth formations, which comprises:

a first string of pipe positioned in said wellbore to serve as a liner for a first portion of said wellbore, said first string of pipe having an axial bore therethrough, the lower end of said first string of pipe being above the bottom of said wellbore, a second string of pipe, means for hanging said second string of pipe from within the bore of the lower portion of said first string of pipe to serve as a liner for a second portion of said wellbore, said second portion extending downwardly from the lower end of said first string of pipe, said second string of pipe having an axial bore therethrough, the outer diameter of said second string of pipe being less than the inner diameter of the bore of said first string of pipe, a tubular member extending upwardly from a first position within the bore of said second string of pipe to a second position within the bore of said first string of pipe above the upper end of said second string of pipe, at least one first annular seal between a lower portion of said tubular member, located within said second string of pipe, and the interior surface of the bore of the laterally adjacent portion of said second string of pipe, at least one second annular seal between an upper portion of said tubular member, located above said second string of pipe, and the interior surface of the bore of the laterally adjacent portion of said first string of pipe, a third string of pipe positioned within the bore of said first string of pipe, said third string of pipe having on the lower end thereof an on-off tool, a latch and seal assembly connected to the lower end of said on-off tool, and a tailpipe extending downwardly from said latch and seal assembly, said latch and seal assembly being positioned within said tubular member, and said tailpipe extending at least partially into the bore of said second string of pipe, said latch and seal assembly releasably securing said latch and seal assembly to said tubular member and providing a fluid seal for the annulus between the interior surface of tubular member and the exterior surface of said latch and seal assembly.

6. Apparatus in accordance with claim 5 wherein said on-off tool comprises a first sleeve and a second sleeve, one of said first and second sleeves having a J shaped slot therein and the other of said first and second sleeves having a projection thereon which is adapted to project into and slide within said slot between a first position wherein said first and second sleeves are thereby secured together and a second position wherein said first and second sleeves are separated from each other, means for connecting said first sleeve to the lower end of said third string of pipe, and means for securing said second sleeve to said latch and seal assembly.

7. Apparatus in accordance with claim 6 wherein said tubular member and said at least one second annular seal constitute a packer.

8. Apparatus in accordance with claim 7 further comprising at least one profile nipple in said tailpipe.

9. A method of isolating the annulus around a wellbore liner and for achieving downhole completion in a wellbore which transverses various earth formations, which comprises:

installing a first string of pipe in said wellbore to serve as a liner for a first portion of said wellbore, said first string of pipe having an axial bore therethrough, the lower end of said first string of pipe being above the bottom of said wellbore, hanging, from within the lower portion of said first string of pipe, a second string of pipe to serve as a liner for a second portion of said wellbore, said second portion extending downwardly from the lower end of said first string of pipe, said second string of pipe having an axial bore therethrough, the outer diameter of said second string of pipe being less than the inner diameter of the bore of said first string of pipe, positioning a tubular member so that it extends upwardly from a first position within the bore of said second string of pipe to a second position within the bore of said first string of pipe above the upper end of said second string of pipe, providing an annular seal between a lower portion of said tubular member, located within said second string of pipe, and the interior surface of the bore of the laterally adjacent portion of said second string of pipe, providing an annular seal between an upper portion of said tubular member, located above said second string of pipe, and the interior surface of the laterally adjacent portion of said first string of pipe, lowering through the axial bore of said first string of pipe a third string of pipe, having on the lower end thereof an on-off tool, a latch and seal assembly connected to the lower end of said on-off tool, and a tailpipe extending downwardly from said latch and seal assembly, until said latch and seal assembly is positioned within said tubular member and said tailpipe extends at least partially below the bore of said tubular member, and activating said latch and seal assembly to releasably secure said latch and seal assembly to said tubular member and to provide a fluid seal for the annulus between the interior surface of tubular member and the exterior surface of said latch and seal assembly.

10. A method in accordance with claim 9 further comprising producing fluid from at least one of said earth formations by passing fluid from the bore of said second string of pipe through said tailpipe, said latch and seal assembly, said on-off tool and said third string of pipe to above ground production facilities.

11. A method in accordance with claim 9 further comprising inserting a plug in said tailpipe, activating said on-off tool to disconnect said third string of pipe from said latch and seal assembly, and withdrawing said third string of pipe from the wellbore while the interior of the bore of said second string of pipe below said tailpipe is isolated from the interior of the bore of said first string of pipe.

12. A method in accordance with claim 9 further comprising causing said latch and seal assembly to become released from said tubular member, and, thereafter simultaneously withdrawing said third string of pipe, said on-off tool, said latch and seal assembly and said tailpipe from said wellbore.

13. A method of achieving downhole completion in a wellbore which transverses various earth formations, a first string of pipe having been installed in said wellbore to serve as a liner for a first portion of said wellbore, said first string of pipe having an axial bore therethrough, the lower end of said first string of pipe being above the bottom of said wellbore, a second string of pipe having been hung from within the lower portion of said first string of pipe, to serve as a liner for a second portion of said wellbore, said second portion extending downwardly from the lower end of said first string of pipe, said second string of pipe having an axial bore therethrough, the outer diameter of said second string of pipe being less than the inner diameter of the axial bore of said first string of pipe, a tubular member having been positioned in said wellbore extending upwardly from a first position within the axial bore of said second string of pipe to a second position within the axial bore of said first string of pipe above the upper end of said second string of pipe, said tubular member having an annular seal between a lower portion of said tubular member, located within said second string of pipe, and the interior surface of the laterally adjacent portion of said second string of pipe, said tubular member having an annular seal between an upper portion of said tubular member, located above said second string of pipe, and the interior surface of the laterally adjacent portion of said first string of pipe, which comprises the steps of:

lowering through the axial bore of said first string of pipe a third string of pipe, having on the lower end thereof an on-off tool, a latch and seal assembly connected to the lower end of said on-off tool, and a tailpipe extending downwardly from said latch and seal assembly, until said latch and seal assembly is positioned with said tubular member and said tailpipe extends at least partially below the bore of said tubular member, and activating said latch and seal assembly to releasably secure said latch and seal assembly to said tubular member and to provide a fluid seal for the annulus between the interior surface of tubular member and the exterior surface of said latch and seal assembly.

14. A method in accordance with claim 13 further comprising producing fluid from at least one of said earth formations by passing fluid from the bore of said second string of pipe through said tailpipe, said latch and seal assembly, said on-off tool and said third string of pipe to above ground production facilities.

15. A method in accordance with claim 13 comprising inserting a plug in said tailpipe, activating said on-off tool to disconnect said third string of pipe from said latch and seal assembly, and withdrawing said third string of pipe from the wellbore while the interior of the bore of said second string of pipe below said tailpipe is isolated from the interior of the bore of said first string of pipe.

16. A method in accordance with claim 13 further comprising causing said latch and seal assembly to become released from said tubular member, and thereafter simultaneously withdrawing said third string of pipe, said on-off tool, said latch and seal assembly and said tailpipe from said wellbore.

* * * * *